US005597090A

United States Patent [19]

Leahy

[11] Patent Number: 5,597,090

[45] Date of Patent: Jan. 28, 1997

[54] CONTROLLED POURABILITY OF FLUIDS

[76] Inventor: David J. Leahy, 415 Franklin St., Framingham, Mass. 01701

[21] Appl. No.: 344,942

[22] Filed: Nov. 25, 1994

[51] Int. Cl.[6] ..... G01F 11/00

[52] U.S. Cl. ..... 222/1; 222/109; 222/111; 222/424; 222/571

[58] Field of Search ..... 222/109, 111, 222/424, 571

[56] References Cited

U.S. PATENT DOCUMENTS

| | | | |
|---|---|---|---|
| 3,964,644 | 6/1976 | Wallace | 222/146.5 |
| 4,550,862 | 11/1985 | Barker et al. | 222/109 |
| 4,981,239 | 1/1991 | Cappel et al. | 222/111 X |
| 5,114,659 | 5/1992 | Krall | 222/111 X |
| 5,131,566 | 7/1992 | Bavegems | 222/109 X |

FOREIGN PATENT DOCUMENTS

| | | | |
|---|---|---|---|
| 0133914 | 8/1946 | Australia | 222/109 |
| 0072349 | 4/1951 | Denmark | 222/571 |

*Primary Examiner*—Joseph Kaufman
*Attorney, Agent, or Firm*—George E. Kersey, Esq.

[57] ABSTRACT

Method and appartus for the pouring of liquids by a partially closed shell extending from a base to a rounded and interrupted tip, with partially opened shell sides extending from the base to the tip which is interrupted by a a "V" shaped notch; the shell has a base advantageously inclined with respect to the pouring axis of the shell to permit downward flow of fluid into an aperture that communicates with the opening in the shell; the shell can be a pouring spout covered by a protective cap which is unscrewed and removed to expose the spout and permit fluid to be poured between open sides along the shell and over a sharp, interrupted edge at a tip, by which flow is terminated when the shell is up-righted, so that the sharpness of the interruption and the general configuration of the tip reduce the usual dripping of fluid after a pour.

17 Claims, 3 Drawing Sheets

CONTROLLED POURABILITY OF FLUIDS

BACKGROUND OF THE INVENTION

This invention relates to the pouring of fluids, and more particularly, to the controlled pouring of semiviscous and viscous fluids such as honey, syrup, corn oil and the like.

There is a tendency for fluids such as honey, syrup, corn oil and the like to drip excessively when poured from the open ends of their containers. Not only is such dripping unsightly and messy, it also is wasteful and necessitates periodic cleaning of sticky, exterior accumulations of fluid.

Such is particularly the case with containers for honey. The mess often associated with the pouring of honey has seriously detracted from the desired use of the product. Dripping also is a problem in the dispensing of cooking oils when unwanted fluid is spread accidentally on cooking surfaces.

At present, the pouring of viscous liquids is accomplished by a variety of different methods. Pouring can take place directly from a container through its open mouth after removing a cap. An alternative method is to have a removable cap covering a valve that is lifted to create an opening from which a liquid can be poured.

For other containers, the cap is an integral part of the valve. When the cap is lifted, a plug portion is removed to create an opening from which to pour liquid.

In other attempts to control undesirable dripping from ordinary containers of syrup, corn oil and other viscous fluids, pouring spouts have been added at the open ends of containers. These spouts generally are threaded to their containers and provide a pouring surface with reduced dripping. The pouring spout can be recessed and covered with a cap.

In other cases the cap and sealing member are molded as a unit with a living hinge. Alternatively, viscous liquids are often spooned or pumped out.

Unfortunately, conventional spouts that reduce dripping, still leave a residual that is particularly objectionable with semiviscous fluids such as honey. In addition conventional pouring spouts are easily damaged while in shelf storage and during transit.

Accordingly it is an object of the invention to improve the performance of pouring spouts that can be protected against damage, both during transit and while in shelf storage. A related object is to provide a pouring spout which cannot be easily broken or damaged.

Another object of the invention is to provide a pouring spout for a drip-prone liquid such as honey, syrup or oil in a glass or metal container, and significantly decrease the tendency for dripping, while avoiding contamination of the external pouring surface.

A principal object of the invention is to provide an improved pouring spout for viscous liquids that tend to cause dripping. The pouring spout is to be effective to reduce dripping, and waste and unsightliness.

A further object of the invention is to provide a method for pouring viscous liquids from a container with control over spilling or dripping. It is another object of the invention to allow the user to have control over the rate of flow, as well as the direction of flow.

Another pouring device for semi-viscous fluids is described in Ernest W. Baxter U.S. Pat. No. 4,128,189 issued Dec. 5, 1978 and titled "Device for Improving the Pourability of Fluids and also Forming an Improved Closure for a Container of Such Fluids". This disclosure is of an internal pouring spout with a useful pouring lip for low viscosity liquids, such as soaps and detergents, but does not function well for relatively high viscosity fluids.

Accordingly, yet another object of the invention is to overcome the disadvantages of pouring spouts designed for low-viscosity fluids. A related object is to enhance the pourability of relatively viscous fluids.

SUMMARY OF THE INVENTION

In accomplishing the foregoing and related objects, the invention provides for the pouring of liquids by a partially closed shell extending from a base to an interrupted tip. The shell desirably is paraboloidal with a rounded and interrupted tip, and partially opened sides extending from the tip to a base.

In accordance with one aspect of the invention, the tip is interrupted by a notch, which can be "V" shaped. The shell has a pouring axis and the base advantageously is inclined with respect to the pouring axis to permit downward flow of fluid on the base when the axis is upwardly positioned. The base is downwardly inclined towards the partial opening in the shell to permit downward flow into the opening from the base when the axis is upwardly positioned.

In accordance with another aspect of the invention, the base includes an aperture that communicates with the opening in the shell, and the base can be a cup surrounding the shell.

The shell can be a pouring spout covered by a protective cap which is unscrewed and removed to expose the spout and permit fluid to be poured between open sides along the shell and over a sharp, interrupted edge at a tip, by which flow is terminated when the shell is up-righted, so that the sharpness of the interruption and the general configuration of the tip reduce the usual dripping of fluid after a pour.

To promote fluid flow and control cut-off of flow, the shell can be molded from a relatively frictionless material, such as polyethylene, polypropylene, or other poly plastic. The shell can have a coating of tetrafluorethylene (TFE) or fluorinated ethylene propylene (FEP).

In accordance with a further aspect of the invention, the pouring spout can be an insert for a container having a neck with an interior surface and be proportioned to fit snugly against the interior.

In a method of the invention for reducing unwanted dripping of fluid from a pouring spout extending from a base of a container to its tip, the steps include (a) causing fluid from within the container to flow into the pouring spout, and therealong, and (b) interrupting the flow at a sharp discontinuous edge at the extremity of the spout tip.

The method can include the step of removing a cap from the end of the container to expose a pouring spout, and the further step of collecting any residual fluid on the exterior of the pouring spout after the interruption of flow at a sharp discontinuity at the extreme end of the spout tip. The method can further include the step of collecting residual fluid by flowing it down an inclined base surrounding the exterior of a pouring spout, and into a base aperture that communicates with the interior of the pouring spout.

In a method of manufacturing a pouring spout for viscous and semiviscous fluids with reduced dripping, the steps can include (a) molding a partially enclosed shell to form a trough for the pouring of fluid from an entry end of the shell to an exit and (b) producing a sharp discontinuity at the exit end to abruptly cut off the flow of fluid when the shell is positioned to control the flow of fluid.

The shell can be produced with a longitudinal opening extending from a entry to an exit end, and the entry end can be produced with a cylindrical cup that has a base which lies in an angled plane with respect to the cylindrical axis of the cup.

DESCRIPTION OF THE DRAWINGS

Other objects and features of the invention will become apparent after considering several illustrative embodiments, taken in conjunction with the accompanying drawings, in which.

DETAILED DESCRIPTION

Figure 1:
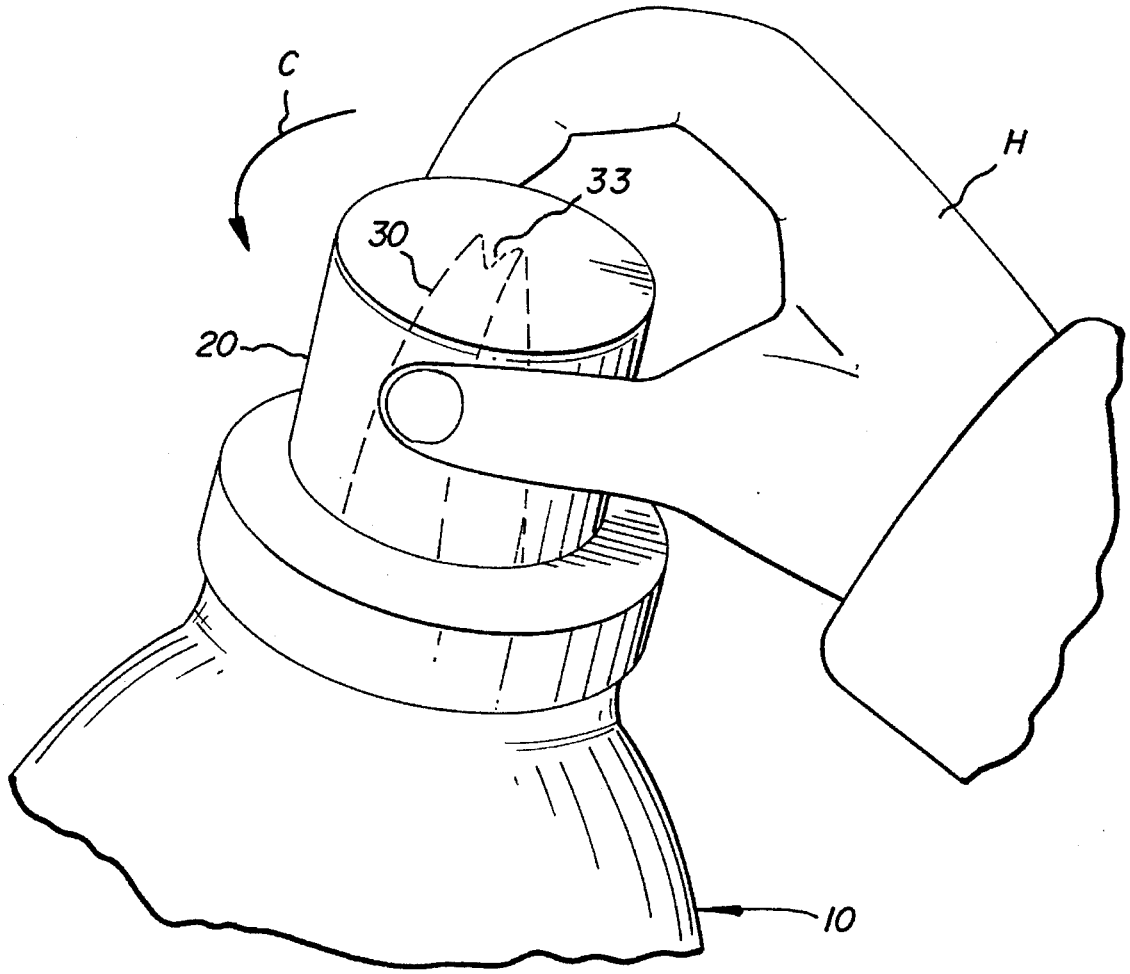
FIG. 1 is a partial perspective view of a cap-protected pouring spout in accordance with the invention.

With reference to the drawings, FIG. 1 shows a container 10 with a pouring spout 30 covered by a protective cap 20. In order to expose the spout 30 and permit the contents of the container 10 to be poured, the cap 20 is unscrewed, illustratively by using the hand H to rotate the cap 20 in a counter-clockwise direction C.

Figure 2:
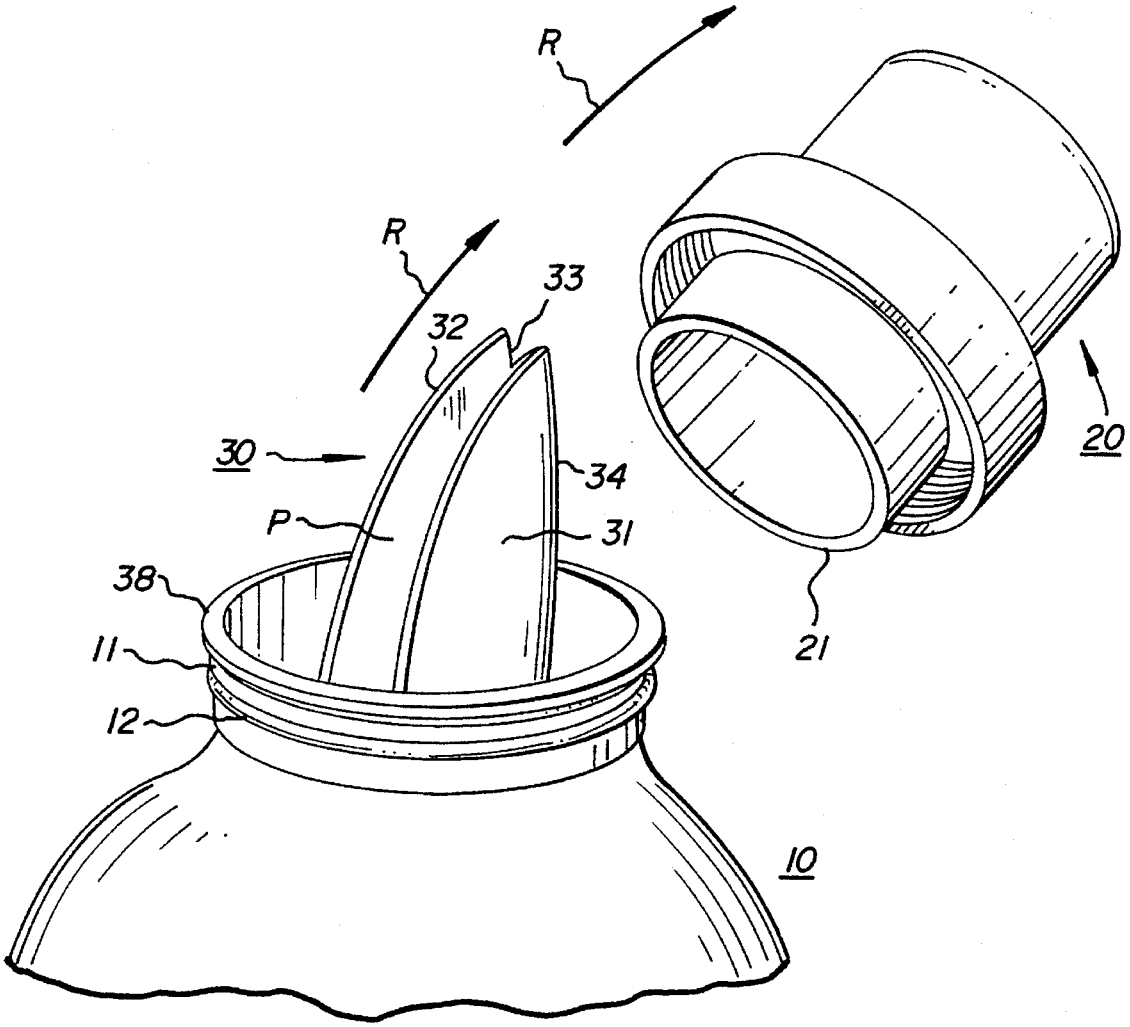
FIG. 2 is a partial perspective view of FIG. 1 with the protective cap removed, exposing the pouring spout of the invention.

Once the cap 20 is unscrewed, as shown in FIG. 2, it is removed in the direction R from the neck 11 of the container 10 at its exterior thread 12. The pouring spout 30 is then exposed and the contents of the container 20 are ready to be poured.

As indicated in FIG. 2, the pouring spout 30 is a partial paraboloid shell 31 with an upper edge 32 that is interrupted, for example by a "V" notch 33. The paraboloid shell 31 acts as a pouring channel P for fluid which passes over the edge 32 and has its flow terminated, when the container is up-righted, by interruption 33 at the upper edge 32.

Because of the sharpness of the interruption 33, and the general configuration of the upper edge 32, the usual dripping of fluid during a pour is significantly reduced. The typical result of such dripping is that fluid flows over the exterior of the container and upon other surfaces as well. As a result, there is an accumulation over time of messy and objectionable waste which necessitates extensive cleaning. In addition, the fluid waste on the outside of the container creates an unsanitary condition by attracting flies and other insects. This is particularly true for semi-viscous fluids, such honey or syrup.

The reverse "V" cut 33 added by the invention in the edge 32 of the pouring spout 20 provides user control over viscous liquid flow. Suitable tilting of the V groove 32 reduces flow and cuts off "stringing" of viscous liquid.

If a final drop of viscous liquid adheres to the outside 34 of the pour spout 30, it eventually returns to the container 10 by gravity down the inclined base 35 to the container opening P. This allows the user to freely pour viscous liquids (honey, molasses, syrups, etc.) without being concerned about getting viscous liquid on the outside of the container 10 for transfer to tables, hands or shelves.

The invention thus provides the user with the necessary control to keep the outside of the container 10 and cap 20 free from viscous liquid that could be transferred to tables and shelves, and attracting insects or animals.

The use of the V groove 33, in addition to cut-off control over flow, also provides for control over the rate of flow. The flow directed through the V groove 33 of the pour spout 31, can be varied from a slow, thin-angle hair-like stream to a heavy, thick stream ranging from ½" or greater.

The groove 33 can range in angular width from 5° to 135°, with the preferred range being from about 15° to 45°. The optimal angle depends upon the viscosity and the desired rate of flow.

The groove 33 also can be non-linear, embodying curves or steps in transition from its apex to the opening at the end 32 of the spout 30.

Figure 3A:
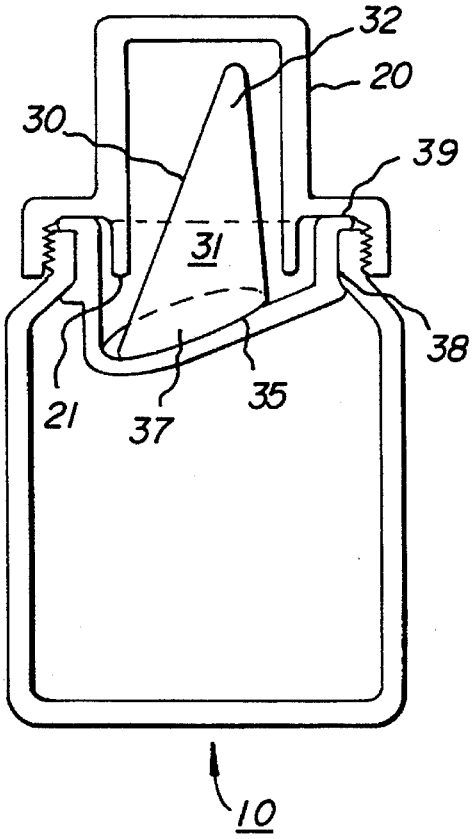
FIG. 3A is a cross-sectional view of FIG. 1.
Figure 3B:
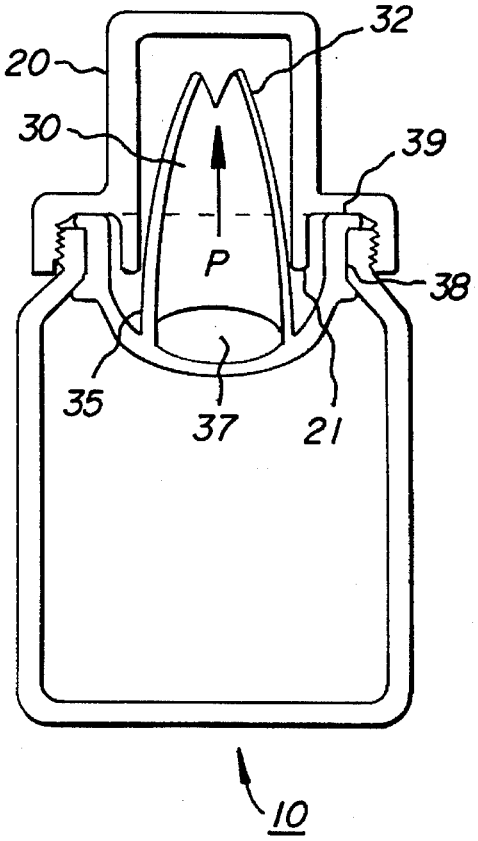
FIG. 3B is a cross-sectional view of FIG. 1.
Figure 4:
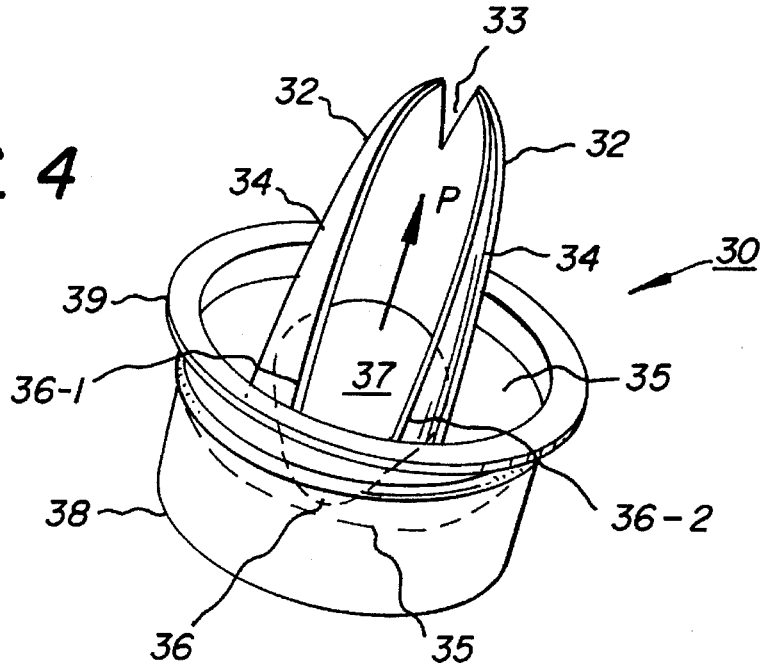
FIG. 4 is a perspective view of the pouring spout of FIGS. 1, 2, 3A and 3B after removal from its associated container.

In order to promote fluid flow and cut-off, the spout 30, illustrated in detail in FIGS. 3A, 3B and 4, is molded from a relatively frictionless material, such polyethylene, polypropylene, polystyrene or similar plastic, desirably with a coating of tetrafluorethylene (TFE) or fluorinated ethylene propylene (FEP). The latter has a slightly higher coefficient of friction than TFE.

The sleeve 31 of the spout 30 extends to the angularly inclined base 35, with an opening 36 that coincides with the edges 36-1 and 36-2. The opening 36 also joins the central opening 37 of the paraboloid 31. The inclined base 35 forms a cup 38 that extends upwardly to a flange 39 that mates with the open end of the container 10 at the neck 11.

In effect, the spout 30 is an insert that is proportioned to fit snugly against the interior surface of the neck 11.

The cap 20 has internal threads that mesh with the exterior thread 12 of the container 10. The cap 20 also has a cylindrical extension 21 which acts as a shield for the spout 31.

The cap 20 also has an internal annular shoulder which bears against the cup 38 and clamps it firmly against the open end of the container 10 to form a firm seal and prevent loss of fluid during transit and storage.

The container can be of any suitable material, such as glass, plastic or metal, and the preferred shape is round. While the cup 38 preferably is of plastic, it can be glass, plastic or metal.

The spout 31 is particularly useful for liquids with viscosities ranging from 5000 centipoises (syrup, liquid detergents) to over 30,000 centipoises (honey).

In operation, the lid 20 is unscrewed and the contents dispensed by passing along the channel P over the V notch 33 of the pouring lips 32. The channel P is sized to prevent a rush of fluid when the container is turned for dispensing. The restriction of flow helps prevent drips and spills. Because the V notch 33 at the edge 32 of the lip 30 is nonwettable, and proportioned for sharp cut-off, there is a virtually dripless dispensing.

At the lowest end of the inclined base 35, the opening 36 serves as a drainage for any fluid that travels along the base, and also serves as a breather that permits the entry of air to displace withdrawn fluid.

The pouring spout 31 does not have to be located concentrically with respect to its cup insert, but can be radially offset.

Although the invention has been illustrated and described in connection with several different embodiments, it will be understood that these are merely examples and that those skilled in the art can make numerous modifications and adaptations without departing from the spirit and scope of the invention as defined by the appended claims and equivalents thereof.

What is claimed is:

1. A pouring spout for pouring viscous and semiviscous fluids with reduced dripping therefrom, comprising:

(a) a paraboloidal shell having entry and exit ends and partially open sides, and forming a conduit for the pouring of fluid from an entry end of said shell to an apex exit end thereof opposite said partially open sides;

(b) said shell having a sharp discontinuity in the form of a V-shaped notch completely interrupting said apex exit end opposite said partially open sides to abruptly cut off the flow of said fluid when said apex exit end is positioned above the path of said flow.

2. A pouring spout as defined in claim 1 wherein said shell has a longitudinal opening extending from the entry end to said exit end and opposing said V-shaped notch of said sharp discontinuity.

3. A pouring spout as defined in claim 1 wherein said entry end is surrounded by a cylindrical cup having a cylindrical axis and a base which lies in an angled plane with respect to said cylindrical axis.

4. Apparatus as defined in claim 1 wherein said V-shaped notch has the width of said shell at the tip thereof.

5. Apparatus as defined in claim 4 wherein said notch is "V" shaped with longitudinally diverging sides extending to said tip.

6. Apparatus as defined in claim 1 wherein said shell has a pouring axis and said base is inclined to provide drainage with respect to said pouring axis;

thereby to permit downward flow of fluid on said base when said axis is upwardly positioned.

7. Apparatus as defined in claim 6 wherein said base is downwardly inclined towards said open sides in said shell.

8. Apparatus as defined in claim 7 wherein said base includes an aperture that communicates with said open sides.

9. Apparatus as defined in claim 8 wherein said base is a cup surrounding said shell and said open sides.

10. Apparatus as defined in claim 1 wherein said shell is a pouring spout covered by a protective cap which is unscrewed and removed to expose said spout and permit fluid to be poured between open sides along said shell and over a sharp edge of said V-shaped notch at said tip, by which flow is terminated when said shell is up-righted;

whereby the sharpness of said notch and the general configuration of said tip reduce the usual dripping of fluid after a pour.

11. Apparatus as defined in claim 1 wherein, to promote fluid flow and control cut-off of flow, said shell is molded from a relatively frictionless material, such as polyethylene, polypropylene, and other poly plastic.

12. Apparatus as defined in claim 1 wherein said shell has a coating selected from the class of tetrafluorethylene (TFE) and fluorinated ethylene propylene (FEP).

13. Apparatus as defined in claim 1 wherein said pouring spout is an insert for a container having a neck with an interior container surface and is proportioned to fit snugly against said interior.

14. The method of reducing unwanted dripping of fluid from a parabaloidal pouring spout having partially open sides extending from a base in said container to a tip, which comprises the steps of:

(a) causing fluid from within said container to flow into said pouring spout and therealong opposite said open sides; and (b) interrupting said flow at a single, V-shaped notch before said tip and extending through said spout opposite said open sides to the extremity of said tip.

15. The method of claim 14 further including the step of removing a cap from the end of said container to expose said pouring spout.

16. The method of claim 14 further including the step of collecting any residual fluid on the exterior of said pouring spout after the interruption of said flow at the sharp discontinuity at the extreme end of said tip.

17. The method of claim 14 further including the step of collecting said residual fluid by flowing it down an inclined base surrounding the exterior of said pouring spout into a base aperture that communicates with the interior of said pouring spout.

* * * * *